United States Patent [19]

Toland

[11] 4,012,545

[45] Mar. 15, 1977

[54] TURF HAVING SOLIDIFIED PLASTICIZED SULFUR BACKING

[75] Inventor: William G. Toland, San Rafael, Calif.

[73] Assignee: Chevron Research Company, San Francisco, Calif.

[22] Filed: Sept. 4, 1975

[21] Appl. No.: 610,500

Related U.S. Application Data

[63] Continuation-in-part of Ser. No. 474,457, May 29, 1974, abandoned.

[52] U.S. Cl. ..... 428/95; 156/325; 423/567 A; 428/96; 428/97

[51] Int. Cl.[2] ..... D03D 27/00; D04H 11/00

[58] Field of Search ..... 428/95, 97, 96; 423/567; 156/325

[56] References Cited

UNITED STATES PATENTS

| | | | |
|---|---|---|---|
| 3,935,352 | 1/1976 | Toland | 428/95 |
| 3,944,452 | 3/1976 | Toland et al. | 428/85 |

*Primary Examiner*—Marion E. McCamish
*Attorney, Agent, or Firm*—G. F. Magdeburger; John Stoner, Jr.; W. Keith Turner

[57] ABSTRACT

A manufacture comprising a plurality of fibers partially embedded in a solidified plasticized sulfur matrix with one end of the fibers extending outward from the matrix to form a turf or carpet-like surface.

8 Claims, 1 Drawing Figure

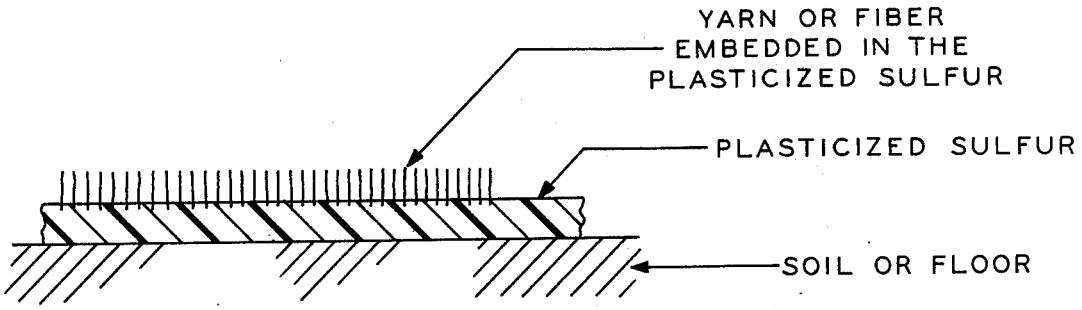
YARN OR FIBER
EMBEDDED IN THE
PLASTICIZED SULFUR
PLASTICIZED SULFUR
SOIL OR FLOOR

TURF HAVING SOLIDIFIED PLASTICIZED SULFUR BACKING

CROSS-REFERENCE TO RELATED APPLICATIONS

This application is a continuation-in-part of U.S. application Ser. No. 474,457, filed May 29, 1974, now abandoned.

The disclosure of my application entitled "Supported Turf or Carpet-Like Material", Ser. No. 474,456, filed May 29, 1974, now U.S. Pat. No. 3,935,352, is related hereto and is incorporated herein by reference.

BACKGROUND OF THE INVENTION

The present invention relates to a synthetic turf or carpet-like manufacture comprising a plasticized sulfur matrix.

Prior patents disclosing synthetic turfs include U.S. Pat. Nos. 3,422,615, 3,332,828, 3,157,557; 2,515,847; 2,061,750, and 1,939,846.

U.S. Pat. No. 3,422,615 discloses a synthetic turf-like material which is referred to as a pile fabric. Fibers which are indicated as being suitable for making the yarns used to make the pile fabric of U.S. Pat. No. 3,422,615 are said to include olefins, particularly polypropylene, nylon, vinyl, vinylidene chloride, polyvinyl chloride, polyethylene, polyester, polyacrylonitrile, acetate, triacetate, rayon (cellulosics), and glass.

U.S. Pat. No. 3,332,828 relates to artificial turf preferably produced by weaving synthetic fibers on a Wilton cut-pile loom to form a structure consisting of a woven backing having a cut-pile face extending from one surface thereof and then applying a suitable latex formation on the other surface of the backing to render the complete struction dimensionally stable.

U.S. Pat. No. 3,157,557 discloses an integrally molded plastic sod simulating natural grass and comprising a flat flexible base of a thick plastic material having a multiplicity of closely spaced, blade-like plastic stems molded integral with the base.

U.S. Pat. No. 2,515,847 discloses a surfacing structure suitable for use as a putting green for golf. The surfacing structure includes a top layer of rug material having a nap. The rug material is supported on center layers of sponge rubber-like material. The supported rug material is placed upon the earth.

U.S. Pat. No. 2,061,750 relates to grass mats prepared by stitching grass-simulated material to a base.

U.S. Pat. No. 1,939,846 discloses distributing fibrous material evenly over the top of a sheet of rubber composition and then vulcanizing the fibers to the sheet in a heat press.

Plasticized sulfur has been disclosed in various references, for example by J. I. Jin in "Chemistry of Plasticized Sulfur", Petroleum Division, A.C.S. Symposium, Vol. 19, No. 2, March 1974, pp. 234–241, and by C. Kinney Hancock in "Platicized Sulfur Compositions for Traffic Marking", Industrial and Engineering Chemistry, Vol. 46, No. 11, November 1954, pp. 2431–2435. Exemplary patents disclosing plasticized sulfur include U.S. Pat. Nos. 3,316,115, "Marking Composition"; 3,434,852, "Plasticized Sulfur Compositions"; 3,447,941, "Sprayable Sulfur Road Marking Compositions"; 3,459,717, "Sulfur-Based Plastic Composition"; 3,560,451, "Plastic and Nonflammable Sulfur Composition"; 3,453,125, "Plasticized Sulfur Compositions"; 3,674,525, "Plasticized Sulfur Compositions"; and 3,676,166, "Plasticized Sulfur Compositions". Also, U.S. Pat. No. 3,823,019 discloses plasticized sulfur compositions.

SUMMARY OF THE INVENTION

According to the present invention, a manufacture is provided comprising a plurality of fibers partially embedded in a solidified, plasticized sulfur matrix with one end of the fibers extending outwardly from the matrix to form a turf or carpet-like surface.

According to a preferred embodiment of the present invention, the sulfur is plasticized with dicyclopentadiene, aliphatic polysulfide, aromatic polysulfide, or mixtures thereof.

The term "fiber" is used herein to include monofilament strands as well as polyfilament strands (yarns and threads and yarns made by twisting a fibrillated thermoplastic tape). Preferably yarn is used to form the product of the present invention. The yarn can be produced by twisting filaments together by methods known in the carpet-producing art. In this regard, see, for example, U.S. Pat. No. 3,422,615. Materials which can be used as the monofilament strands or as the polyfilament strands, that is, yarns, include synthetic plastic materials as well as animal-derived materials such as wool. Preferably synthetic materials are used, i.e., synthetic plastic materials capable of being formed into filaments and yarns, for example by extruding into a pellicle and then cut or shredded into filaments which can in turn be converted to yarns. Polypropylene is a particularly preferred synthetic plastic material for forming fibers for use herein, and a particularly preferred polypropylene yarn is made by twisting fibrillated polypropylene tapes. Other materials which can be used include other polyolefins, polyethylene terephthalate, polyacrylonitrile, viscose rayon, cellulose acetate, nylon, polyvinyl chloride, and fibrous glass.

In addition to U.S. Pat. No. 3,422,615, U.S. Pat. Nos. 3,177,557, 3,242,035 and 3,332,828 disclose materials which can be used to produce monofilament strands as well as polyfilament strands (yarns) for making artificial turf.

Among other factors, the present invention is based on my finding of the surprisingly advantageous adherence of solidified plastic sulfur to fibers, especially fibers such as polypropylene, and especially polypropylene in the form of pieces of yarn. Also, the combination product of the present invention has been found to possess particularly attractive durability and serviceability characteristics, so that it can advantageously be used in surfaces subjected to abusive foot traffic.

"Plasticized sulfur" as the term is used herein usually has a lower melting point and a higher viscosity than elemental sulfur. Furthermore, plasticized sulfur requires a longer time to crystallize; i.e., the rate of crystallization of plasticized sulfur is slower than that of elemental sulfur. One useful way to measure the rate of crystallization is as follows: The test material (0.040 g) is melted on a microscope slide at 130° C and is then covered with a square microscope slide cover slip. The slide is transferred to a hot plate and is kept at a temperature of 78±° C, as measured on the glass slide using a surface pyrometer. One corner of the melt is seeded with a crystal of test material. The time required for complete crystallization is measured. Plasticized sulfur, then, is sulfur containing an additive which increases the crystallization time within experimental error, i.e., the average crystallization time of the plasticized sulfur is greater than the average crystallization time of the elemental sulfur feedstock. For the present application, plasticizers are those substances which, when added to molten, elemental sulfur, cause an increase in crystallization time in reference to the elemental sulfur itself. In one set of experiments, elemental sulfur required 0.44 minute to crystallize under the above conditions, whereas sulfur containing 3.8% of a phenol-sulfur adduct (as described in U.S. Pat. No. 3,892,686 required 2.9 minutes. Sulfur containing 6.6% and 9.9% of the same phenol-sulfur adduct required 5.7 and 22 minutes, respectively.

Inorganic plasticizers include iron, arsenic and phosphorus sulfides, but the particularly preferred plasticizers are organic compounds which can react with sulfur to give sulfur-containing materials, such as styrene, alphamethylstyrene, dicyclopentadiene, vinyl cyclohexene, the aromatic compound-sulfur adducts of U.S. Pat. No. 3,892,686, as well as the aromatic compounds used to produce these adducts, aromatic or aliphatic liquid polysulfides (e.g., those sold under the trade name of Thiokol LP-3 or LP-32), and the viscosity control agents described in U.S. Pat. Nos. 3,674,525, 3,453,125 and 3,676,166. The preferred aromatic plasticizing compounds are styrene and the phenol-sulfur adduct of U.S. Pat. No. 3,892,686. The preferred aliphatic compound is dicyclopentadiene. Preferred amounts of the plasticizer are 0.1 to 20 weight percent more preferably 0.5 to 10 weight percent.

The plasticized sulfur matrix may contain constituents in addition to the main sulfur ingredient and the sulfur plasticizer. Inorganic fillers such as sand or other finely divided aggregate, and preferably mica, asbestos, or talc or mixtures thereof, can be included. Preferably the amount of such filler is 0.1 to 45 weight percent, but particularly in the case of the mica, asbestos and talc, or mixtures thereof, the preferred amount is 0.1 to 15 weight percent, and more preferably 0.1 to 10 weight percent.

The elemental sulfur may be either crystalline or amorphous and may contain small amounts of impurities such as those normally found in commercial grades of sulfur. Optimum proportions of sulfur, as well as of the other components of the composition may vary considerably. The plasticized sulfur matrix should have above about 50 weight percent sulfur. Proportions of sulfur of about 73 to 97%, by weight, are preferred.

One preferred plasticized sulfur substance contains dicyclopentadiene, sulfur, glass fiber and talc. Amounts of these ingredients preferably are, by weight, about 65 to 97% sulfur, about 1 to 7% dicyclopentadiene, about 1 to 5% glass fiber, and about 1 to 15% talc.

Dicyclopentadiene is readily available commercially, generally at a purity of about 96% or greater. Preferably it is used in the above preferred plasticized sulfur composition in an amount of about 1 to 7% by weight.

The glass fiber of the above preferred plasticized sulfur composition is preferably employed in the form of milled fibers, with the fibers generally ranging from about 1/32 to ¼ inch in length, preferably with an average length of about 1/16 inch. These fibers, which generally consist of high-silica glass, are readily available commercially, often coated with a starch binder. The type of glass is, however, not critical, as long as it provides the resulting composition with adequate shear strength, preferably a shear strength of about 400 to 800 psi. The glass fiber preferably constitutes about 1 to 5% by weight of the composition of the invention.

The talc used in the preferred dicyclopentadiene-sulfur-glass fiber-talc composition preferably is a foliated type, or a compact variety such as steatite. Impure varieties such as soapstone can also be used. This ingredient is preferably used in an amount of about 1 to 15% by weight of the composition, and serves the dual function of providing thixotropy to the mixture and of dispersing the glass fiber throughout the composition, thereby preventing agglomeration of the fibers.

The preferred composition is used as a receiving matrix for the turf-forming fibers as a fluid mixture of the ingredients, with the sulfur and dicyclopentadiene in molten form and the glass fiber and talc distributed throughout the molten material. Thus the composition is prepared by homogeneous mixing of the ingredients at elevated temperature sufficient to maintain the sulfur and dicyclopentadiene in a molten state. A temperature of about 240° to 320° F is satisfactory, with about 275° to 320° being preferred. Any conventional vessel or reactor capable of providing the required temperature and mixing means may be used for preparation of the composition.

DRAWING

The drawing is a schematic illustration of an embodiment of the present invention. As shown in the drawing, the plasticized sulfur rests on the soil or floor, and yarns or fibers are embedded into the plasticized sulfur. The thickness of the plasticized sulfur can vary, but typically is between about ¼ to 3 inches, more usually between about ½ and 2 inches thick. One advantage in preparing the product of the present invention is that it can be prepared for outdoor applications on the site as well as being capable of being prepared in modules or sections in a plant.

Usually the product is prepared by immersing or embedding fibers in the molten plasticized sulfur and then removing a backing or other means which might be used to hold the fibers or yarn elements in place when they are embedded in the molten plasticized sulfur and during the solidification of the plasticized sulfur. Means for implanting fibers into molten plasticized sulfur are also discussed in my joint-inventorship and commonly assigned application Ser. No. 474,458, entitled "Artificial Turf Preparation", filed May 29, 1974, now U.S. Pat. No. 3,944,452, the disclosure of which application is incorporated herein by reference.

Fibers may also be implanted into the molten, plasticized sulfur matrix by a floc process. In this process the fibers of an appropriate denier and previously cut to the desired length can be dropped from a feed hopper and passed through an electrically charged grid positioned between the feed hopper and the molten, plasticized sulfur surface. In passing through the electrically charged grid, the fibers become aligned with the force field which extends from the grid to the earth. Thus, the fibers drop parallel to one another and perpendicular to the sulfur matrix. After the fibers become imbedded, the liquid sulfur composition is allowed to solidify, thereby producing a solid base with an evenly spaced coating of fibers. In addition to gravity feed, the fibers may be sprayed or propelled, e.g., in a generally downward direction, by an air stream or similar method of conveyance. Preferably an elctrostatic field completes the alignment of fibers. An apparatus for depositing fibers on an ordinary carpet backing of this type of implanting procedure is described in U.S. Pat. No. 3,379,175, the disclosure of which is incorporated herein with respect to the implanting procedure. Yarns may be implanted in the plasticized sulfur matrix by the flocking process, but monofilament fibers are preferred, and for the present invention polypropylene fibers are especially preferred.

EXAMPLE 1

Plasticized Sulfur Mastic as a Carpet Base

A plasticized sulfur mastic was prepared by heating a mixture of 3 parts of dicyclopentadiene and 100 parts of molten sulfur until there was a noticeable increase in viscosity. Next, 10 parts of talc and 3 parts of glass fiber (milled to ⅛ inch lengths) were added and the whole mixture was stirred until it was homogenous. This material was then poured onto a flat 12×18 inches area of ground covered with small-sized gravel to a depth of ⅜ inch. Before the sulfur mastic hardened, a sheared or cut-pile indoor-outdoor carpet, made by tufting polypropylene yarn into a polypropylene primary backing and without latex or other secondary backing, was laid on the mastic, backing side down — cut end of fibers up, so that the tufts on the backing side were submerged in the mastic. When the mastic had hardened, a corner of the backing was pried loose, and then the entire backing was pulled upward, through the cut piles, leaving the tufts securely anchored in the smooth, hard mastic surface. The finished installation had the appearance of a grassy lawn.

One unexpected beneficial advantage of the product was the excellent adherence and retention of the polypropylene fibers or yarn by the plasticized sulfur.

EXAMPLE 2

Non-Plasticized Sulfur Mastic as a Carpet Base a. A small (4×4 inches) piece of polypropylene tufted indoor-outdoor carpet was immersed upside down (about ¼ inch) into a molten sulfur-glass fiber mixture ½ inch deep. When the sulfur had hardened, the carpet backing was cut off, leaving a grass-like structure held in place by the solidified sulfur-glass fiber mixture.

b. The same experiment was repeated except that the glass fibers were replaced by sand. The results were the same.

The above experiment indicates that sulfur, with or without an added material such as talc or sand or glass fiber, can be used in the present invention instead of plasticized sulfur. However, my other experimental work indicates that plasticized sulfur performs better in the present invention.

What is claimed is:

1. A manufacture comprising a plurality of fibers partially embedded in a solidified plasticized sulfur matrix with one end of the fibers extending outward from the matrix to form a turf or carpet-like surface.

2. A manufacture in accordance with claim 1 wherein the sulfur is plasticized with dicyclopentadiene, aliphatic polysulfide, aromatic polysulfides, or mixtures thereof.

3. A manufacture in accordance with claim 1 wherein the fibers are wool, cotton, nylon, polypropylene, polyethylene, polyurethane, or mixtures thereof.

4. A manufacture in accordance with claim 1 wherein the fibers are polypropylene.

5. A manufacture in accordance with claim 1 wherein the plasticized sulfur comprises, by weight, 0.1 to 10% organic compound sulfur plasticizer, 0.1 to 10% inorganic filler and above about 50% sulfur.

6. A manufacture in accordance with claim 1 wherein the plasticized sulfur comprises, by weight, about 65 to 97% sulfur, about 1 to 7% dicyclopentadiene, about 1 to 5% glass fiber, and about 1 to 15% talc.

7. A manufacture in accordance with claim 1 prepared by embedding the fibers in the molten plasticized sulfur and then allowing the plasticized sulfur to solidify.

8. A manufacture in accordance with claim 1 wherein the fibers are polypropylene and wherein the manufacture is prepared by embedding the fibers in the molten plasticized sulfur and then allowing the plasticized sulfur to solidify.

* * * * *